United States Patent [19]

Pfefferle

[11] 4,384,843

[45] May 24, 1983

[54] COMBUSTION METHOD AND APPARATUS WITH CATALYTIC TUBES

[75] Inventor: William C. Pfefferle, Middletown, N.J.

[73] Assignee: United States of America, Washington, D.C.

[21] Appl. No.: 149,541

[22] Filed: May 13, 1980

[51] Int. Cl.[3] ..... F23D 3/40; F23D 19/00

[52] U.S. Cl. ..... 431/7; 431/268; 252/477 R; 60/39.822

[58] Field of Search ..... 431/7, 268; 60/723, 60/39.06, 295, 299, 300, 301, 302, 39.82 C; 252/477 R

[56] References Cited

U.S. PATENT DOCUMENTS

| | | | |
|---|---|---|---|
| 3,255,123 | 6/1966 | Haensel | 252/477 R |
| 3,405,010 | 10/1968 | Kordesch et al. | 252/477 R |
| 3,770,389 | 10/1973 | Kitzner et al. | 252/477 R X |
| 3,790,350 | 2/1974 | Haensel | 60/301 X |
| 3,814,589 | 6/1974 | Heitland | 60/300 X |
| 3,928,961 | 12/1975 | Pfefferle | 431/7 X |
| 4,101,287 | 7/1978 | Sweed et al. | 252/477 R X |
| 4,235,588 | 11/1980 | Tanaka | 431/268 X |
| 4,280,329 | 7/1981 | Rackley et al. | 431/7 X |

FOREIGN PATENT DOCUMENTS

| | | | |
|---|---|---|---|
| 1281054 | 2/1961 | France | 60/39.82 C |

*Primary Examiner*—Larry Jones

*Attorney, Agent, or Firm*—Flehr, Hohbach, Test, Albritton & Herbert

[57] ABSTRACT

A thermal shock resistant catalytic combustor has a plurality of catalytic tubes of a high temperature catalytically active ceramic mounted such that the ceramic is free to expand or contract. Ends of the tubes can be maintained at any desired temperature below combustion temperatures.

9 Claims, 3 Drawing Figures

COMBUSTION METHOD AND APPARATUS WITH CATALYTIC TUBES

The invention described herein was made in the course of, or under a contract, with the Environmental Protection Agency.

The present invention relates to the design of practical combustors utilizing ceramic catalysts. A serious limitation on the use of monolithic catalysts in catalytic combustors is that ceramic materials tend to fail when subjected to large variations in operating temperatures. This severely restricts the use of such catalysts in many combustor applications since rapid cycling of combustion temperature is often required in combustors such as those for gas turbines. Present catalytic combustor designs typically require ceramics which possess a greater thermal shock resistance than is available from high temperature ceramics.

It is an object of this invention to provide a method and apparatus for combustion of fuels over a catalyst which allows cycling of the combustion temperature at rates equivalent to those experienced by conventional thermal combustors.

It is further an object of this invention to provide a catalytic reactor which is not damaged by rapid heating or cooling.

Another object is to provide catalyst structures and methods of use which obviate thermal shock problems.

The invention in summary provides a method of burning fuels and a combustor which incorporates a catalyst comprised of thin walled tubes mounted such that longitudinal expansion is not restrained.

Figure 1:
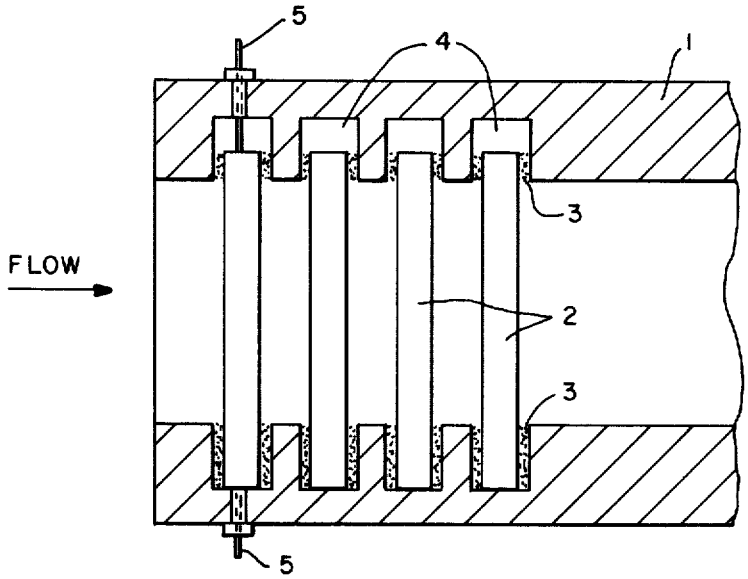
FIG. 1 is a fragmentary axial section view of a combustor with thin walled straight tubes of catalytic ceramic in accordance with one embodiment of the present invention.
Figure 2:
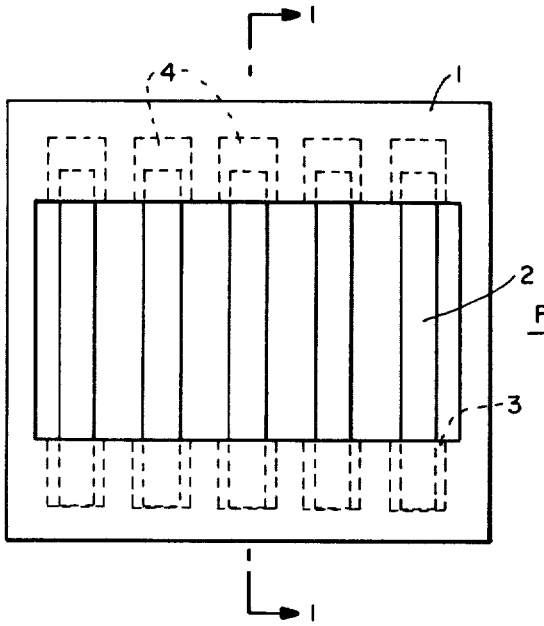
FIG. 2 is a front elevation view of the combustor of FIG. 1.

FIG. 1 illustrates an embodiment incorporating a combustor shell 1 which carries a plurality of straight, thin walled catalyst tubes 2. One end of each of the tubes 2 is mounted by ceramic cloth packing 3, and the spaces 4 within the shell provide expansion area for the opposite ends of the tubes. The straight tubes 2 could also be carried by slip mountings at both ends so that each end is free to move upon expansion and contraction. Optional electrical connectors 5 can be provided for electrical preheating of the catalyst on start-up where electrically conductive tubes are used.

In operation of the combustor 1 a fuel-air mixture enters at one end and is combusted over the catalyst, for example as is described in U.S. patent 3,928,961. The amount of expansion space 4 required is readily calculated by those skilled in the art based on the coefficients of expansion of the materials used and on the operating temperature limits.

Figure 3:
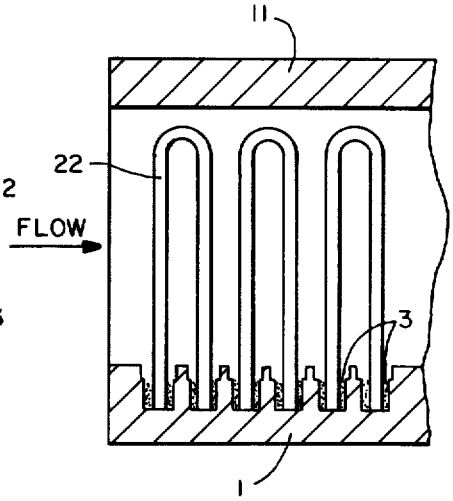
FIG. 3 is a fragmentary axial section view of a combustor incorporating U-tube catalysts in accordance with another embodiment of the present invention.

FIG. 3 illustrates another embodiment incorporating a combustor shell 11 which mounts a plurality of U-tubes 22. The inlet and outlet ends of each of the tubes are mounted within combustor shell 11 and these ends are wrapped with ceramic cloth 3. The free ends of the tubes can expand and contract without restraint.

In the invention the novel combination of thin walls and restraint-free mounting solves the thermal shock problem encountered with conventional catalytic combustor designs. The catalyst of the tubes can be a ceramic oxide of the spinel type, or a high melting catalytically active ceramic. Ceramics with a high coefficient of thermal expansion, such as a nickel doped stabilized zirconia, may be employed. Accordingly, a ceramic may be selected on the basis of its high temperature and catalytic properties without regard to its coefficient of expansion.

In both embodiments the tube walls should be thick enough for handling, i.e. at least about 2–5 mils depending on the ceramic but no thicker than about 50 mils. Tube walls in the range of 5 to 10 or 20 mils are preferred. In general, wall thickness is such as to limit temperature differences between inner and outer surfaces to no more than about 25° C. and preferably to no more than about 10° C. Tubes may be of any desired length but are prefereably about 16 to 18" in length depending on the application. Although circular cross-section tubes are most convenient to use, other cross-sectional shapes such as oval or egg shaped tubes can be employed to reduce aerodynamic drag. The tubes may be arranged or stacked in any convenient manner so long as no significant restraints are placed on tube movement.

The invention has been described in detail with reference to specific preferred embodiments thereof, but it will be understood that variations and modifications can be effected within the spirit and scope of the invention.

What is claimed is:

1. A method of catalytically burning fuels to obviate the effects of thermal stresses in a catalyst structure, the method comprising the steps of passing a mixture of fuel and air over the catalyst structure at elevated temperatures, said catalyst structure comprising a plurality of structurally independent tubes fixedly mounted on at least one of their respective ends to a support such that longitudinal expansion of the tubes is not restrained, said tubes having walls of a thickness in the range of 2 to 50 mils for avoiding unequal thermal gradients of high magnitude and thereby obviating destructive internal thermal stresses.

2. The method of claim 1 in which the tubes have a wall thickness of from 2 to 20 mils.

3. The method of claim 1 in which said catalyst is electrically conductive and is electrically heated on start-up.

4. The method of claim 1 in which said catalyst is a high melting ceramic.

5. A combustor for catalytically burning fuels to obviate the effects of thermal stresses in a catalyst structure comprising a support, and a plurality of structurally independent tubes having a catalystically active surface, said tubes being fixedly mounted on at least one of their respective ends to the support such that longitudinal expansion of the tubes is not restrained, said tubes having walls of a thickness in the range of 2 to 50 mils for avoiding unequal thermal gradients of high magnitude and thereby obviating destructive internal thermal stresses in the tubes.

6. The combustor of claim 5 in which the tubes have a wall thickness of from 2 to 20 mils.

7. The combustor of claim 5 in which said catalyst is a high melting ceramic.

8. The combustor of claim 5 in which at least one of the tubes is a straight tube restrained at only one of its ends.

9. The combustor of claim 5 in which at least one of the tubes is U-shaped having a free curved end between inlet and outlet ends, said inlet and outlet ends being fixedly mounted on the support with the free end unrestrained.

* * * * *